US005318364A

United States Patent [19]

Raden

[11] Patent Number: 5,318,364

[45] Date of Patent: Jun. 7, 1994

[54] SECURITY BAG

[76] Inventor: David T. Raden, 2701 W. 121st Ter., Leawood, Kans. 66209

[21] Appl. No.: 967,796

[22] Filed: Oct. 28, 1992

[51] Int. Cl.[5] ..... B65D 33/34

[52] U.S. Cl. ..... 383/5

[58] Field of Search ..... 383/5

[56] References Cited

U.S. PATENT DOCUMENTS

| | | | |
|---|---|---|---|
| 3,933,304 | 1/1976 | Judd . | |
| 3,942,713 | 3/1976 | Olson et al. . | |
| 4,417,658 | 11/1983 | Gardner et al. . | |
| 4,464,158 | 8/1984 | Kardon . | |
| 4,483,018 | 11/1984 | Whelan . | |
| 4,509,196 | 4/1985 | Sak et al. . | |
| 4,510,621 | 4/1985 | Sak et al. . | |
| 4,550,831 | 11/1985 | Whitford . | |
| 4,653,113 | 3/1987 | Taylor . | |
| 4,709,397 | 11/1987 | Voshall et al. . | |
| 4,709,399 | 11/1987 | Sanders . | |
| 4,712,729 | 12/1987 | Craig . | |
| 4,720,040 | 1/1988 | Gurewitz . | |
| 4,733,817 | 3/1988 | Makowka . | |
| 4,786,190 | 11/1988 | Van Erden et al. . | |
| 4,941,196 | 7/1990 | Edelman et al. | 383/5 |
| 4,988,547 | 1/1991 | Voto, Jr. et al. . | |
| 5,077,001 | 12/1991 | Makowka | 383/5 |
| 5,108,194 | 4/1992 | Raden . | |

FOREIGN PATENT DOCUMENTS

| | | | |
|---|---|---|---|
| 549840 | 12/1957 | Canada . | |
| 0393841 | 10/1990 | European Pat. Off. | 383/5 |
| 2671331 | 7/1992 | France | 383/5 |
| 0296654 | 12/1990 | Japan | 383/5 |
| 2051003 | 1/1981 | United Kingdom | 383/5 |
| 2138396 | 10/1984 | United Kingdom | 383/5 |
| 2167381 | 5/1986 | United Kingdom . | |

*Primary Examiner*—Stephen P. Garbe

*Attorney, Agent, or Firm*—Michael Yakimo, Jr.; D. A. N. Chase

[57] ABSTRACT

A closure system for a plastic security bag comprises an access opening of the security bag formed by the displaced top edges of the front and rear panels. An adhesive laden carrier film regulates access thereto. The film has an internal line of serration and is affixed to the bag below the top edge of the front panel. A band of temperature-sensitive "hot melt" is supplied therealong. Upon removal of the releasable liner the carrier film is positioned such that the hot melt contacts the rear panel of the bag with the edges of the carrier film aligned with the edges of the rear panel to preclude purchase of the edges. The bag bears ink indicia which deteriorates upon chemical substances being sprayed thereon in an attempt to fracture the adhesive bond. The flush edges of the bag and/or the water-based indicia preclude an undetected, undesirable access to the bag. The bag has scalloped marginal edges which are separable if one attempts to enter the bag at the marginal edges. The attributes of the cellophane carrier film causes cracking if subject to cold temperature. The cellophane also separates at the line of serration if separated from the rear panel. The above characteristics present evidence of an attempted, improper entry to the bag. Proper entry to the bag is accomplished by tearing the carrier film and/or bag proper which is evident to an observer.

20 Claims, 2 Drawing Sheets

TAMPER EVIDENT TAMPER EVIDENT TAMPER EVIDENT

SECURITY BAG

BACKGROUND OF THE INVENTION

This invention generally relates to containers and more particularly, to an improved security bag having a closure system resistant to undesirable opening and indicative of physical and/or chemical tampering therewith.

Known security bags are expensive to manufacture and have various degrees of resistance to tampering. One type of bag, as shown in U.S. Pat. No. 4,483,019 comprises a plastic bag closed at one end with a foldable flap. Adhesive materials in the bag and flap are brought into a mating relationship upon folding the flaps so as to close the access opening of the bag proper. Such a bag appears to be relatively expensive to manufacture.

Another type of security bag is shown in U.S. Pat. No. 4,510,621 which illustrates a security pouch with an access opening flanked by pressure sensitive adhesive. Upon folding the pouch onto itself the access opening seal which precludes radial axis thereto.

U.S. Pat. No. 4,464,158 discloses a method of making a tamper-proof bag closure which applies a band of microcapsules along the access opening. Upon folding the flap along the fold line ready entry into the access opening is precluded.

My U.S. Pat. No. 5,108,194, which issued on Apr. 28, 1992, illustrates a tamper evident leak-proof security bag which presents a positive seal along the access opening without the need to fold the mating surfaces of the bag in a facing relationship and without the need for critical user attention.

I have invented another security bag which further reduces undesirable entry therein by mechanical means or by applying freon onto the front and rear portions of the bag adjacent the sealed access opening. Freon or heat application has been used by intruders to weaken or fracture the adhesive bond which seals the access opening. This condition allows an unauthorized entry into the bag which may not be evident to the proper bag recipient. I also provide a sealed access opening at the top of the bag which hinders an undesirable intruder from gaining any substantial purchase without tearing on the upper edges of the bag that form the access opening. Thus, an undesirable and undetectable access to the bag is, if not precluded, substantially reduced.

My new security bag now comprises a container/bag made of a plastic material folded into front and rear panels which are heat sealed along the extent of their longitudinal marginal edges. At the top edge of the front panel is affixed a cellophane carrier film with a hot-melt type of adhesive bond material thereon. A releasable liner extends along the adhesive bond to preclude an undesirable, premature adhesion of the carrier film to the rear panel. An optional information panel at the top edge of the rear panel is removable therefrom along a line of serration. The front panel top edge is lower than the rear panel top edge so as to present an adhesion panel. Upon use the releasable liner is removed from the adhesive material. The carrier film is then brought into contact with the rear adhesion panel. The top edges of the film and adhesion panel are sealed in a lateral alignment with no portions thereof available for purchase to a user. The front and rear bag panels have ink indicia thereon which are responsive to a chemical agent being sprayed thereon. Upon an unauthorized user trying to break the adhesive bond of the access opening by spraying freon or applying heat thereon, the cellophane and indicia thereon will crack and/or the ink indicia on the panels will distort all which are readily apparent to the proper bag recipient. The carrier film has lines of serration therein which will cause the film to separate upon an attempt to separate the carrier film from the rear panel. Scalloped edges along the marginal edges of the bag or film further cause tearing if entry is attempted by separating the panels or the carrier film from the sealed rear panel. The use of the above bag elements, jointly and severally, provide a tamper evident security bag. Moreover, the attributes of the cellophane carrier film and/or adhesive make it difficult to mask the resulting intruder-induced distortions.

Accordingly, it is a general object of the invention to provide a novel closure system for a security bag or the like.

Another object of the invention is to provide a closure system, as aforesaid, which precludes separation of the access opening to the bag during use.

Still a further object of the invention is to provide a closure system, as aforesaid, which is tamper evident.

Another object of this invention is to provide a closure system, as aforesaid, which presents means for sealing the access opening of the bag by means of an adhesive-laden carrier film which will fracture under cold temperatures.

A further object of this invention is to provide a closure system, as aforesaid, having a carrier film separable along lines of serration.

Another object of this invention is to provide a closure system, as aforesaid, having scalloped edges along the marginal edges of the bag and carrier film which are separable upon a user entry into the bag.

A particular object of this invention is to provide a closure system, as aforesaid, which precludes a premature, undesirable sealing of the access opening.

Another particular object of this invention is to provide a closure system, as aforesaid, which indicates attempts to weaken the adhesive bond of the sealed access opening by application of heat, cold and chemical agents or the like.

Still another object of this invention is to provide a closure system with carrier film and adhesive thereon which resists masking of distortions resulting from attempted entries into the bag.

A further object of this invention is to provide a closure system, as aforesaid, which minimizes a purchase of the structural elements forming the access opening to reduce an undetectable entry thereto.

Other objects and advantages of the invention become apparent of the following description taken in connection with the accompanying drawings, wherein is set forth by way of illustration and example a now preferred embodiment of the invention.

DESCRIPTION OF THE PREFERRED EMBODIMENT

Turning more particularly to the drawings, FIGS. 1–4 illustrate the closure system 100 incorporated into a plastic bag 10. The bag may be constructed of any desired material, inclusive of an opaque or transparent, plastic material.

Figure 7:
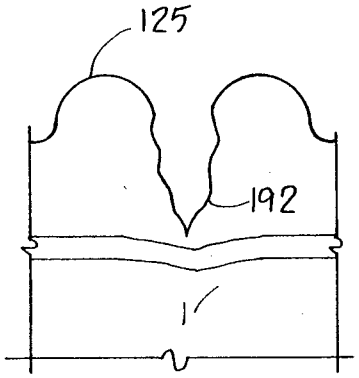
FIG. 7 is a fragmentary view, on an enlarged scale, showing the tearing between a pair of adjacent scallops upon an attempted bag entry.
Figure 6:
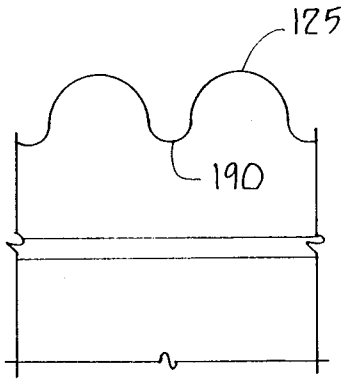
FIG. 6 is a fragmentary view, on an enlarged scale, showing a pair of adjacent scalloped edges of the bag.
Figure 5:
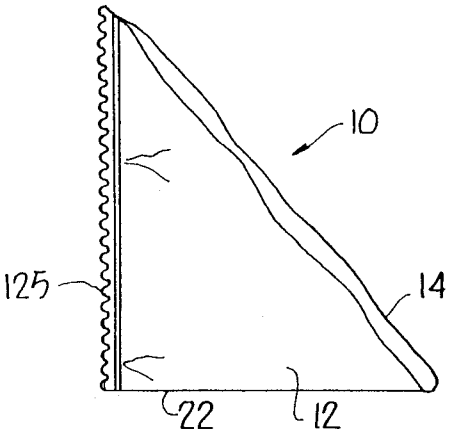
FIG. 5 is a fragmentary view showing the scalloped edge at a bag corner.

The bag 10 includes generally rectangular front 12 and rear 14 panels of a low slip film. These panels 12, 14 are sealed together along their marginal edges to form longitudinal side edges 16, 18 and a folded lower edge 22. The bag side edges 16, 18 are preferably scalloped 125 in configuration. This configuration will cause the adjacent scallops to separate or tear 192 at their common point 190 if one attempts to enter the bag by separating the panels 12, 14 (FIG. 7). This tear will make an unauthorized entry evident to the authorized bag recipient.

Figure 8:
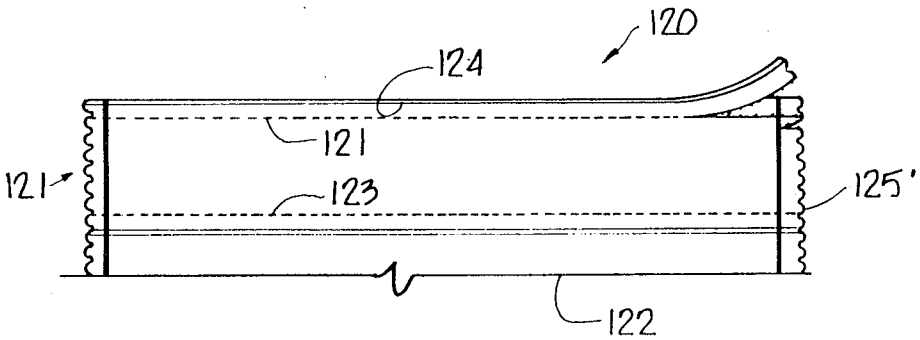
FIG. 8 is an elevation view of the carrier view showing a separation along a line of serration and a tearing between the scallops.

The closure system 100 includes a rectangular strip of cellophane carrier film 120 having a lower edge 122 and an upper edge 124. The lower edge 122 is contiguous to front panel 12 and laterally extends below the upper edge 13 of the front panel 12 of the bag. The cellophane film 120 has laterally extending lines of serration 121, 123 at the top and bottom thereof (FIG. 8).

An adhesive material 140 is placed along the carrier film strip 120. Such material is commonly referred to as "hot melt." One hot melt utilized is a Lexem Consolidated, Inc. adhesive which will crack along with the strip 120 under a cold temperature such as the application of freon. Such hot melt is applied along the entire length of carrier film 120 and adjacent the top edge 124 thereof. This "hot melt" affixes the lower edge 122 of the carrier film 120 below the top edge 13 of front panel 12 such that the lower edge 122 of the carrier film 120 laterally extends below one edge 13 of the access opening 104. This edge 122 presents a line 142 about which the carrier film 120 may rotate or otherwise move between its FIG. 3 and FIG. 1 positions. The remaining "hot melt" above the strip substantially extends toward the top edge 124 of the carrier film.

A releasable liner 182 is placed along the remaining extent of the carrier film 120 to preclude premature adhesion of the "hot melt" on the carrier film 120 with the adhesion portion 17 of the rear panel 14. The carrier film 120 with liner 182 is rotatable about the lower affixed edge or strip 142 to a FIG. 3 position for a subsequent liner removal. A portion of this liner 182 is shown as partially removed in FIGS. 3 and 4 to show the top edge 124 and hot melt adhesive 140 of the carrier film 120.

The back panel 14 includes a top edge 14 which presents a line of serration. An optional information panel 19 upwardly extends from this serrated edge 15. The top edge 15 of rear panel 14 is displaced from the tope edge 13 of front panel 12. This displacement presents a panel portion 17 of the rear panel 14. This panel 17 present a bonding surface for the adhesive 140 on the carrier film 120.

Along the exterior of the carrier film 120 and on the panels 12, 14 are located printed indicia 500. The indicia are printed on panels 12, 14 with a water based, ink such as Sun chemical water based ink. Upon use the stored item is placed through the access opening 104 of the bag as presented by the top edges 13, 15 of the front 12 and rear 14 panels. The information panel 19 is removed along the line of serration 15. Subsequently the releasable liner 182 of the film 120 is removed so as to expose the hot melt adhesive material 140. The carrier film 120 is then upwardly rotated about the strip 142 to its FIG. 1 position and into contact with the adhesion panel 17 of the back panel 14 of the bag. This action aligns the top edge 124 of film 120 with the top edge 15 of panel 14 as well as the longitudinal edges which closes the access opening 104. The exposed hot melt 140 on film 120 contacts the rear adhesion panel 17 so as to seal the access opening 104. The adhesion of the hot melt 140 to rear panel 14 precludes an easy, undetectable, mechanical separation of the carrier film 20 therefrom. Moreover, the marginal longitudinal edges of the film 120 and panel 17 are likewise contacted with the adhesive 140 which in combination with the marginal seals 105 at the ends of edge 13 preclude any access in or leakage from the sealed opening 104. The upper and marginal edges of the sealed bag 100 are substantially flush which precludes any purchase of these edges by an unauthorized user attempting entry into the bags.

Figures 1, 2, 3, 4:
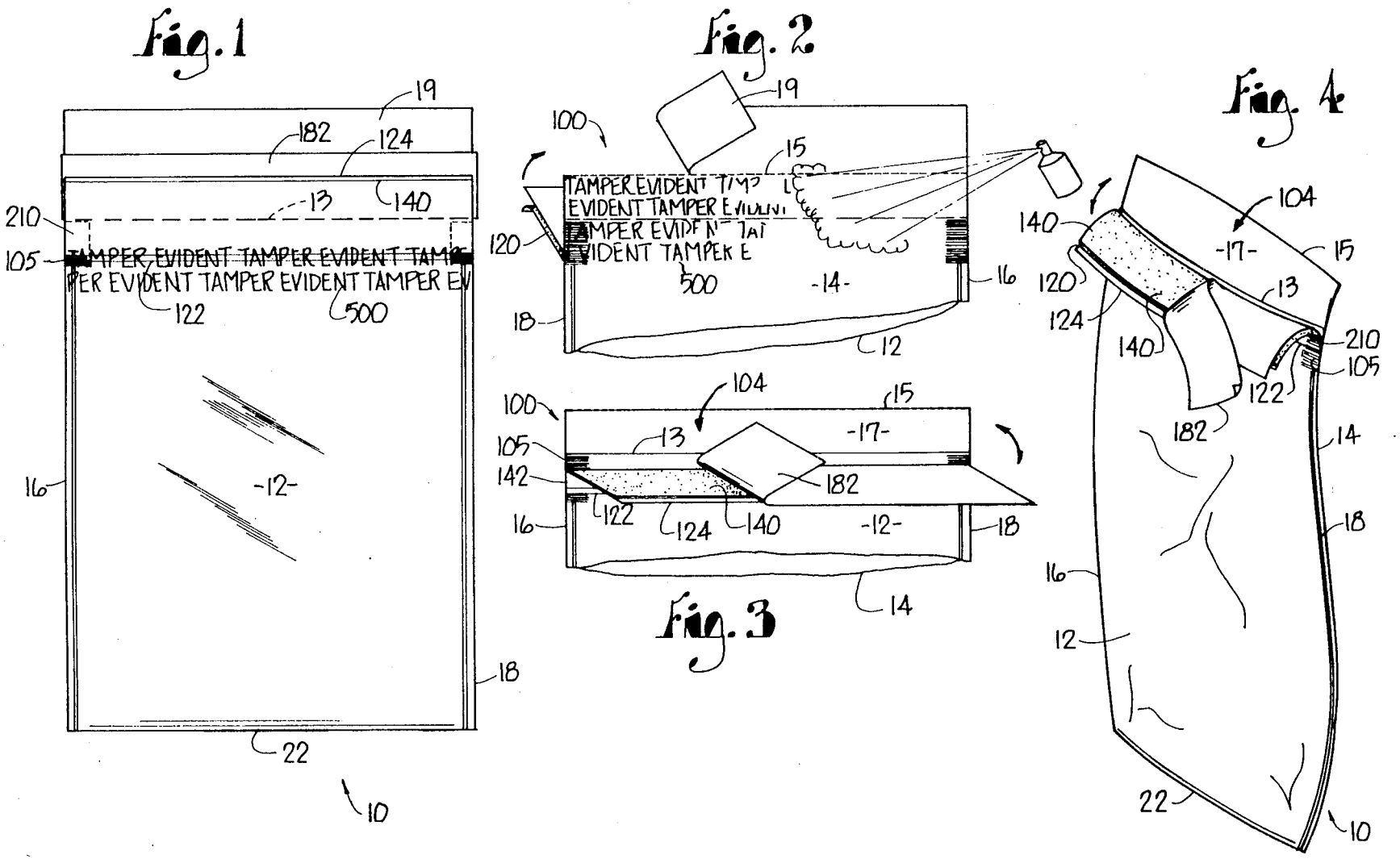
FIG. 1 is a front plan elevation view of the bag prior to a closure position.
FIG. 2 is a rear fragmentary view of the top of the bag in FIG. 1 showing the partial separation of the upper information panel from the rear bag panel and diagrammatically showing the spraying of freon on an indicia-laden portion of the bag.
FIG. 3 is a front fragmentary view of the top portion of the bag showing the relationship among the bag, releasable liner and carrier film.
FIG. 4 is a perspective view of the bag with a portion of the releasable liner being removed from the carrier film.

Moreover, as diagrammatically shown in FIG. 2 if one attempts to weaken the adhesion bond along the access opening 104 by spraying freon or the like on the adhesive 140, the carrier film 120 and adhesive 140 thereon will tend to crack which is evident to an observer. This cracking will cause the indicia on film 120 to likewise crack which is recognizable to a prudent observer. Moreover, the indicia 500 on the bag panels 12, 14 will deteriorate as the ink which was printed on untreated film is susceptible to distortion upon such chemical tampering. This indicia 500 makes it further evident that access to the bag has either been achieved or attempted by use of a chemical agent.

Also, if one attempts to weaken the adhesive bond 140 and separate the film 120 from its closure position, the film will tend to separate along the lines of serration 121, 123 (FIG. 8) or tear at the scalloped edges 125 (FIGS. 7, 8) which will also become evident to the user.

It is understood that such distortions are not easily masked if one attempts to heat the adhesive to melt the adhesive so as to reseal the bag after opening. The bag panels will distort if excessive heat is applied thereon. It will also be very difficult to mask the distorted indicia, adhesive and carrier film.

The use of the cellophane carrier film 120, hot melt adhesive 140, lines of serration 121, 123 scalloped edges 125, film 120 indicia and inked indicia 500 on the film 120 and/or panels 12, 14 all contribute, Jointly and severally, to present a tamper evident security bag 10.

Subsequent authorized access to the opening is achieved only by ripping the carrier film and/or the panels 12, 14 which is also readily evident to the observer.

It is to be understood that while a certain form of this invention has been illustrated and described it is not limited thereto except insofar as such limitations are included in the following claims and allowable equivalents thereof.

Having thus described the invention what is claimed as new and desired to be secured by Letters Patent is as follows:

1. In a security bag formed by front and rear panels joined together at their respective longitudinal and a lower marginal edge, a closure system comprising:

an upper marginal edge at the top of each panel for forming boundaries of an access opening between the panels said top edge of said front panel displaced below said top edge of said rear panel;

a temperature-sensitive carrier film extending between the opposed longitudinal marginal edges and along the length of said upper marginal edge of said front panel, said carrier film having a portion attached to the front panel at a position generally below said upper marginal edge of said front panel;

a free edge defining the upper edge of said carrier film, said free edge displaced from said attached carrier film portion;

a band of adhesive material positioned along the extent of said carrier film;

a releasable liner extending along said adhesive material to preclude an undesirable adhesion of said carrier film to said panels;

a plurality of indicia on the exterior of said bag, said indicia susceptible to distortion upon contact with a substance capable of weakening a bond formed by said adhesive; and said carrier film movable about said attached portion into a contiguous relationship against said rear panel with at least said upper edge of said rear panel aligned with said upper edge of said carrier film to close said opening, said adhesive material exposed upon a user release of said liner from said adhesive for contacting said rear panel and spanning said aligned upper edges to seal the same, said aligned upper edges precluding a purchase of said edges and ingress to said opening with said distortion of said indicia indicating an attempt to weaken the adhesive material sealing said opening.

2. The system as claimed in claim 1 wherein said attached carrier film portion provides an axis for movement of said carrier film from a position displaced from said rear panel to said contiguous position against said rear panel.

3. The system as claimed in claim 2 wherein said carrier film is cellophane, said cellophane susceptible to a user-evident distortion upon application of a substance capable of weakening said adhesive thereon.

4. The system as claimed in claim 3 wherein said carrier film has scallops along its marginal edges, said scallops separable upon an attempted entry into said bag by separating said film from said rear panel.

5. The system as claimed in claim 1 wherein said upper edge of said rear panel is displaced from said upper edge of said front panel to present a portion of said rear panel for contact with said carrier film with said adhesive material thereon.

6. The system as claimed in claim 5 wherein said carrier film includes a pair of opposed longitudinal edges in alignment with the opposed longitudinal marginal edges of said bag rear panel upon said movement to said contiguous relationship.

7. The system as claimed in claim 5 further comprising at least one line of serration across said carrier film, said carrier film being separable therealong upon removal of said film from said rear panel.

8. The system as claimed in claim 1 further comprising an information panel extending along said upper edge of said rear panel, said panel providing a surface to record the contents of said bag thereon.

9. The system as claimed in claim 8 wherein said information panel is detachable from said upper edge of said rear panel.

10. The system as claimed in claim 1 wherein said plurality of said distortable indicia is on at least one of said panels.

11. The system as claimed in claim 10 wherein said indicia is susceptible to a chemical spray capable of weakening said adhesive bond.

12. The system as claimed in claim 11 wherein said indicia comprises inked markings on said bag.

13. The system as claimed in claim 1 wherein said marginal edges are scalloped in configuration, said scallops separable upon an attempted entry into said bag by displacing said panels.

14. In a security bag formed by front and rear panels joined together at their respective longitudinal and lower marginal edges, a closure system comprising:

an upper marginal edge at the top of each panel for forming boundaries of an access opening between the panels, said upper edge of said rear panel displaced from said upper edge of said front panel to present a portion of said rear panel extending beyond said front panel;

a temperature-sensitive carrier film extending between the opposed longitudinal marginal edges and along the length of said upper marginal edge of said front panel, said carrier film having a portion attached to the front panel at a position generally below said upper marginal edge of said front panel;

a line of serration along said carrier film;

a free edge defining the upper edge of said carrier film, said free edge displaced from said attached carrier film portion;

a band of temperature-sensitive adhesive material positioned along the extent of said carrier film;

a releasable liner extending along said adhesive material to preclude an undesirable adhesion of said carrier film to said panels;

said carrier film movable about said attached portion into a contiguous relationship against said rear panel portion with at least said upper edge of said rear panel aligned with said upper edge of said carrier film to close said opening, said adhesive material exposed upon a user release of said liner from said adhesive for contacting said rear panel portion and spanning said upper edge of said front panel and aligned upper edges to seal said closed opening, said carrier film separable along said line of serration upon separation of said carrier film from said rear panel.

15. The system as claimed in claim 14 further comprising:

a plurality of indicia on the exterior of said bag and adjacent said opening, said indicia susceptible to distortion upon contact with a substance capable of weakening said adhesive, said distorted indicia indicative of an attempt to enter said bag.

16. The system as claimed in claim 14 wherein the marginal edges of the bag are scalloped in configuration, said scallops being separable upon an attempted entry into said bag at said marginal edges.

17. The system as claimed in claim 15 wherein the marginal edges of the bag are scalloped in configuration, said scallops being separable upon an attempted entry into said bag at said marginal edges.

18. The system as claimed in claim 17 wherein the marginal edges of the carrier film are scalloped in configuration, said scallops being separable upon an attempted entry into said bag by removing said carrier film from said rear panel.

19. The system as claimed in claim 14 wherein the marginal edges of the carrier film are scalloped in configuration, said scallops being separable upon an attempted entry into said bag by removing said carrier film from said rear panel.

20. In a security bag formed by front and rear panels joined together at their respective longitudinal and lower marginal edges, a closure system comprising:

an upper marginal edge at the top of each panel for forming boundaries of an access opening between the panels;

means for sealing the access opening by positioning a temperature-sensitive carrier film with a temperature-sensitive band of adhesive material thereon along the extent of said opening, said film or adhesive susceptible to distortion upon contact with a substance capable of weakening said adhesive;

a plurality of indicia on the exterior of said bag and adjacent said opening, said indicia susceptible to distortion upon contact with a substance capable of weakening said adhesive;

a scalloped configuration along the marginal edges, said scallops susceptible to distortion upon an attempted entry into said bag by separating said marginal edges;

a line of serration across said carrier film, said film susceptible to distortion along said line upon separation of said film from said opening, said distortions indicative of an attempt to enter said bag;

a scalloped configuration along marginal edge of said carrier film, said scallops susceptible to distortion upon an attempted entry into said bag by separating said film from said opening.

* * * * *